US009512973B2

(12) United States Patent
Lee

(10) Patent No.: US 9,512,973 B2
(45) Date of Patent: Dec. 6, 2016

(54) SHIELD APPARATUS FOR LOW-BEAM HEAD LAMP

(71) Applicant: Hyundai Motor Company, Seoul (KR)

(72) Inventor: Seong Hoon Lee, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 122 days.

(21) Appl. No.: 14/333,029

(22) Filed: Jul. 16, 2014

(65) Prior Publication Data

US 2015/0167914 A1 Jun. 18, 2015

(30) Foreign Application Priority Data

Dec. 18, 2013 (KR) ..... 10-2013-0158792

(51) Int. Cl.
*F21S 8/10* (2006.01)

(52) U.S. Cl.
CPC ..... *F21S 48/145* (2013.01)

(58) Field of Classification Search
CPC ..... F21S 48/13; F21S 48/145
See application file for complete search history.

(56) References Cited

U.S. PATENT DOCUMENTS 1,364,812 A * 1/1921 Rutter ..... B60Q 1/1438 362/325
2003/0165066 A1* 9/2003 Watanabe ..... F21S 48/1778 362/523
2011/0261576 A1 10/2011 Uchida

FOREIGN PATENT DOCUMENTS

KR 10-1998-022800 A 7/1998
KR 10-2010-0122644 A 11/2010
KR 1020100122640 A 11/2010
KR 1020110007856 A 1/2011
KR 10-2013-0047521 A 5/2013

* cited by examiner

*Primary Examiner* — Elmito Breval
(74) *Attorney, Agent, or Firm* — Morgan, Lewis & Bockius LLP

(57) ABSTRACT

A shield apparatus for a low-beam head lamp may include a projection reflector equipped with a light source therein, a shield body having a through hole being formed in the shield body towards a lens, wherein the shield body may be coupled to a front surface of the projection reflector, and wherein the through hole includes a high beam distribution area and a lower beam distribution area, and a plurality of blind shields coupled to the shield body to cover the low-beam distribution area of the through hole and arranged one above another other, wherein the blind shields may be inclined at a predetermined angle to guide an irradiation direction of light outputted from the light source towards the low-beam distribution area.

6 Claims, 4 Drawing Sheets

SHIELD APPARATUS FOR LOW-BEAM HEAD LAMP

CROSS REFERENCE TO RELATED APPLICATION

The present application claims priority of Korean Patent Application Number 10-2013-0158792 filed on Dec. 18, 2013, the entire contents of which is incorporated herein for all purposes by this reference.

BACKGROUND OF THE INVENTION

1. Field of the Invention

The present invention relates, in general, to shield apparatuses for low-beam head lamps, and, more particularly, to a shield apparatus for a low-beam head lamp, which includes a plurality of blind shields that are opened at a predetermined angle, thus achieving an increase in light efficiency of a low-beam distribution area.

2. Description of Related Art

Generally, a four-lamp projection head lamp refers to a head lamp, in which an optical module realizing a low beam and an optical module realizing a high beam are separated from each other, and two optical modules are mounted to the left and right sides of a front of a vehicle, respectively. In other words, this heat lamp has four optical modules in total.

As shown in FIGS. 1 and 2, the head lamp realizing the low beam includes a light source 1. A projection reflector 2 reflects light that is outputted from the light source 1. A shield plate 3 is coupled to a front surface of the projection reflector 2, and is formed such that a low-beam distribution area 3*a* is closed and a high-beam distribution area is open via a through hole 3*b*. A lens 4 is provided in front of the shield plate 3.

However, when the shield plate 3 having the closed low-beam distribution area 3*a* is used as such, some of the light outputted from the light source 1 is reflected by the projection reflector 2 and the closed low-beam distribution area 3*a* of the shield plate 3, and then is finally radiated to the high-beam distribution area through the through hole 3*b*. In this case, because of the amount of light radiated to the high-beam distribution area, the amount of light radiated to the low-beam distribution area is relatively insufficient. Consequently, as the light efficiency of the low-beam distribution area is reduced, this does not satisfy the vehicle safety standard of every country.

The foregoing is intended merely to aid in the understanding of the background of the present invention, and is not intended to mean that the present invention falls within the purview of the related art that is already known to those skilled in the art.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a shield apparatus for a low-beam head lamp, which includes a plurality of blind shields that are opened at a predetermined angle, thus changing the direction of light radiated to a high-beam distribution area so that it is radiated to a low-beam distribution area, and increasing the light efficiency of the low-beam distribution area, therefore satisfying the vehicle safety standard of every country.

In an aspect of the present invention, a shield apparatus for a low-beam head lamp may include a projection reflector equipped with a light source therein, a shield body having a through hole being formed in the shield body towards a lens, wherein the shield body is coupled to a front surface of the projection reflector, and wherein the through hole may include a high beam distribution area and a lower beam distribution area, and a plurality of blind shields coupled to the shield body to cover the low-beam distribution area of the through hole and arranged one above another other, wherein the blind shields are inclined at a predetermined angle to guide an irradiation direction of light outputted from the light source towards the low-beam distribution area.

The shield apparatus may further include a shield cover integrally connecting opposite ends of each of the plurality of blind shields to each other, wherein the shield cover is fixedly coupled to the shield body.

Each of the blind shields is installed at a downwardly inclined angle such that a first end thereof protruding towards the lens is located to be lower than an opposite second end thereof.

Each of the blind shields may have a triangular cross-section in such a way that a tip thereof faces towards the lens, thus guiding the irradiation direction of light reflected by the blind shield towards the low-beam distribution area.

Among the plurality of blind shields, an uppermost blind shield is formed such that a length thereof protruding towards the lens is longer than a length of the remaining blind shields, thus preventing some of the light outputted from the light source from being radiated to the high-beam distribution area.

For a reference line that is perpendicular to a vertical cross-section of the shield body and connects the shield body to the tip of the blind shield, an angle between the reference line and an upper surface of the blind shield is larger than an angle between the reference line and a lower surface of the blind shield, thus guiding the irradiation direction of light reflected by the upper and lower surfaces of the blind shield towards the low-beam distribution area.

A determining factor for guiding the irradiation direction of the light outputted from the light source towards the low-beam distribution area may include the angle between the reference line and the upper surface of the blind shield, the angle between the reference line and the lower surface of the blind shield, and a gradient angle of an interior lower reflecting surface of the projection reflector by which the light of the light source is reflected.

As apparent from the above description, the shield apparatus for the low-beam head lamp among the four-lamp projection head lamp is advantageous in that it includes the inclined blind shields to change the direction of the light radiated to the high-beam distribution area so that it is radiated to the low-beam distribution area, thus significantly increasing the amount of light radiated to the low-beam distribution area, and increasing light efficiency, therefore sufficiently satisfying the vehicle safety standard of every country.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
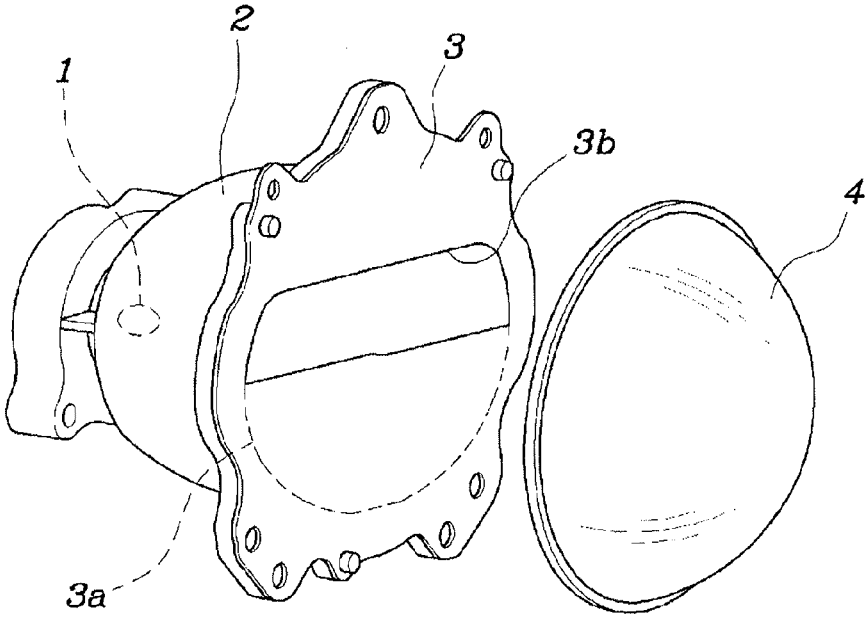
FIG.1 (Related Art)
FIG. 1 is a perspective view showing a conventional head lamp for a low beam.
Figure 2:
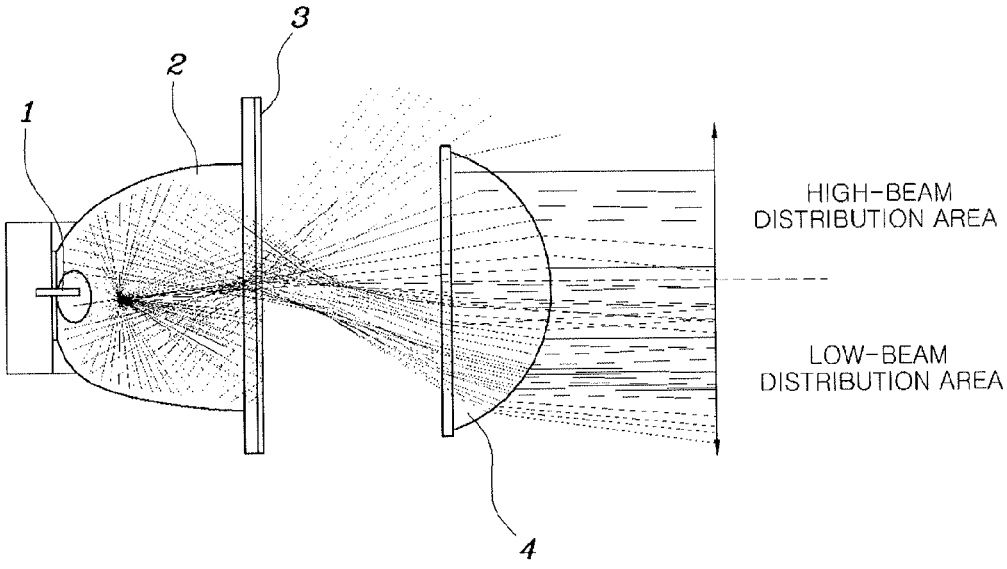
FIG.2 (Related Art)
FIG. 2 is view showing the irradiation path of light outputted from a light source when a conventional shield plate is applied.
Figure 3:
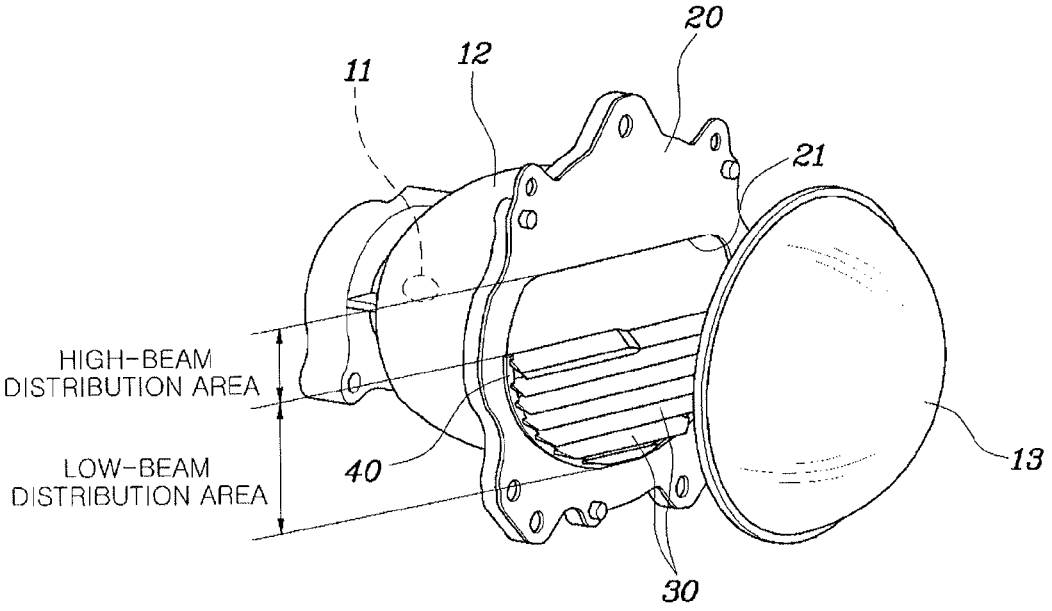
FIG. 3 is a perspective view showing a low-beam head lamp having blind shields according to an exemplary embodiment of the present invention.
Figure 4:
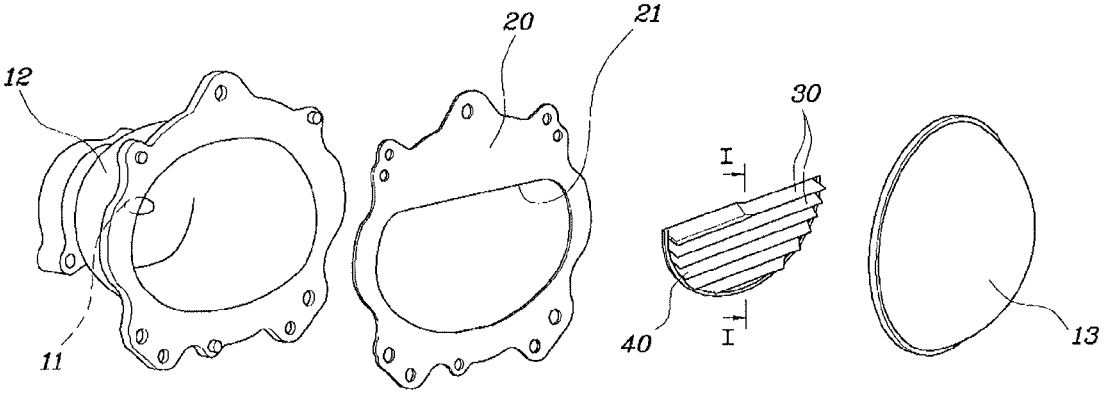
FIG. 4 is an exploded perspective view of FIG. 3.
Figure 5:
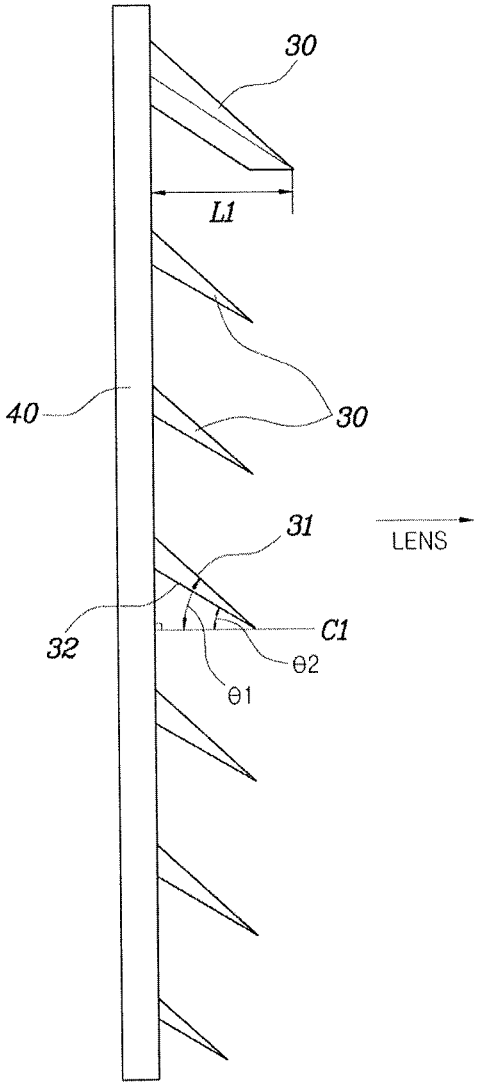
FIG. 5 is a sectional view taken along line I-I of FIG. 4.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinbelow, a shield apparatus for a low-beam head lamp according to the preferred embodiment of the present invention will be described with reference to the accompanying drawings.

As shown in FIGS. 3 to 6, the low-beam head lamp according to an exemplary embodiment of the present invention includes a light source 11. A projection reflector 12 reflects light that is outputted from the light source 11. A shield apparatus is coupled to the projection reflector 12, and realizes a low beam with the light outputted from the light source 11. A lens 13 is provided in front of the shield apparatus.

The shield apparatus according to an exemplary embodiment of the present invention includes a shield body 20 which is coupled to a front surface of the projection reflector 12, with a through hole 21 being formed in the shield body towards the lens 13. A plurality of blind shields 30 is coupled to the shield body 20 to cover only a low-beam distribution area of the through hole 21, and is arranged one above the other. The blind shields 30 are inclined at a predetermined angle to guide the irradiation direction of light outputted from the light source 11 towards the low-beam distribution area.

The shield apparatus according to an exemplary embodiment of the present invention further includes a shield cover 40 that integrally connects the opposite ends of each of the plurality of blind shields 30 to each other. As the shield cover 40 is fixedly coupled to the shield body 20, the blind shields 30 are mounted to the shield body 20.

Each of the blind shields 30 is installed at a downwardly inclined angle such that its first end protruding towards the lens 13 is located to be lower than its opposite second end. Thus, the low-beam distribution area of the through hole 21 in which the blind shields 30 are installed is not completely closed, but is opened towards the lens 13 through the inclined blind shields 30. Thereby, the light outputted from the light source 11 is radiated through the opening towards the lens 13.

According to an exemplary embodiment of the present invention, each of the blind shields 30 has a triangular cross-section in such a way that a sharp tip thereof faces towards the lens 13. Such a configuration allows the light outputted from the light source 11 and reflected by the blind shield 30 to be radiated not to the high-beam distribution area but to the low-beam distribution area.

Further, according to an exemplary embodiment of the present invention, among the plurality of blind shields 30, an uppermost blind shield is formed such that a length L1 thereof protruding towards the lens 13 is longer than that of the remaining blind shields, thus preventing some of the light outputted from the light source 11 from being radiated to the high-beam distribution area.

Moreover, for a reference line C1 that is perpendicular to a vertical cross-section of the shield body 40 and connects the shield body 40 to the sharp tip of the blind shield 30, an angle $\Theta$1 between the reference line C1 and an upper surface 31 of the blind shield 30 is larger than an angle $\Theta$2 between the reference line C1 and a lower surface 32 of the blind shield 30, thus guiding the irradiation direction of light reflected by the upper and lower surfaces 31 and 32 of the blind shield 30 towards the low-beam distribution area.

In the case of applying the downwardly inclined blind shields 30 as in the present invention, when the angle $\Theta$1 between the reference line C1 and the upper surface 31 of the blind shield 30, the angle $\Theta$2 between the reference line C1 and the lower surface 32 of the blind shield 30, and the gradient angle of an interior lower reflecting surface 12*a* of the projection reflector 12 by which the light of the light source 11 is reflected are appropriately tuned, the light outputted from the light source 11 can be radiated not to the high-beam distribution area but to the low-beam distribution area.

Figure 6:
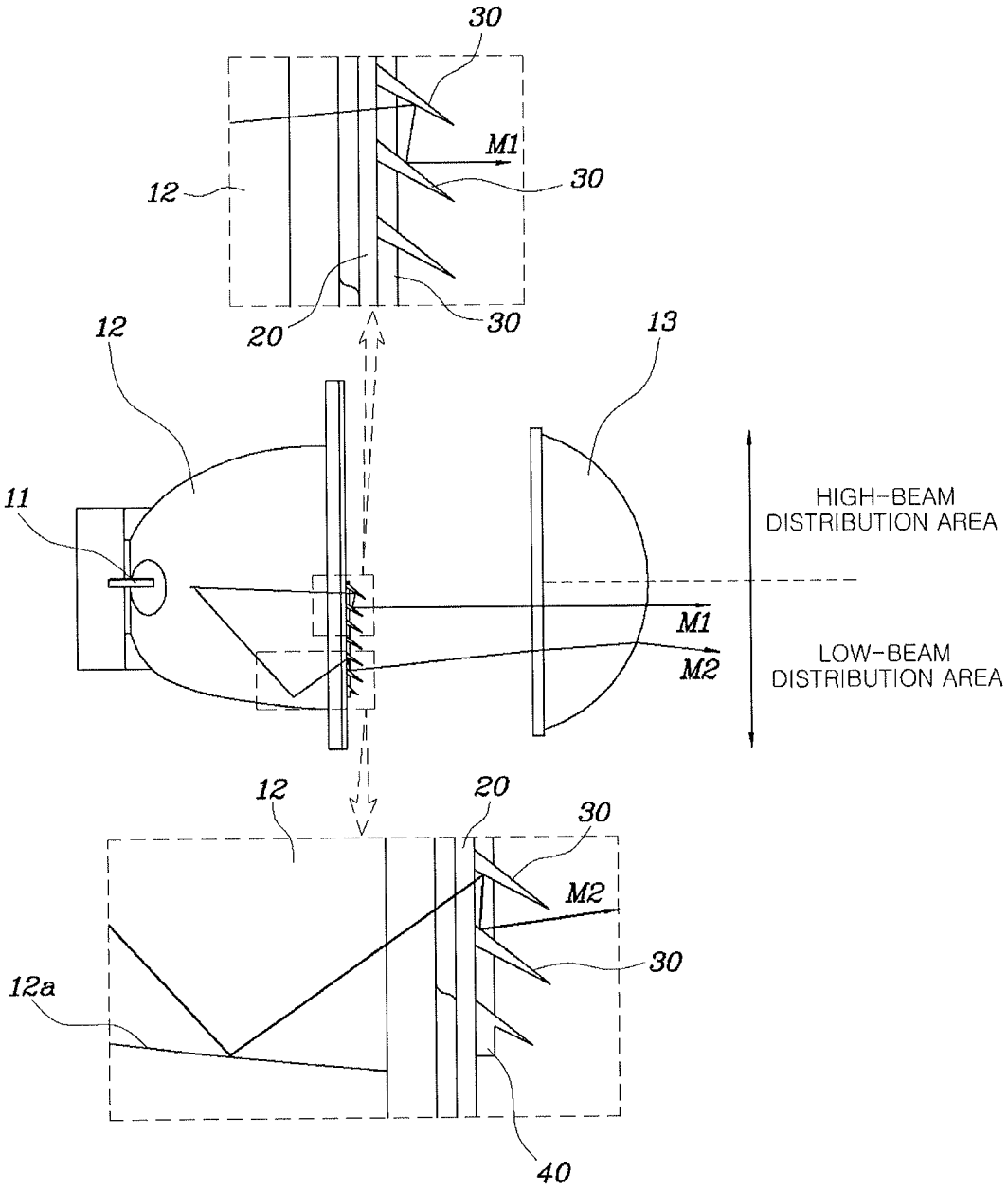
FIG. 6 is a view showing the moving path of light radiated to a low-beam distribution area through the blind shields according to an exemplary embodiment of the present invention.

FIG. 6 shows a path wherein light outputted from the light source 11 is reflected by the blind shields 30 according to an exemplary embodiment of the present invention and then is radiated to the front.

As shown in the drawing, light following an irradiation path M1 is light that is outputted from the light source 11, is not reflected by the projection reflector 12, and is directly radiated towards the blind shields 30. Here, when light reaches the lower surface 32 of the uppermost blind shield 30, the light is reflected by the lower surface 32 of the uppermost blind shield 30 and the upper surface 31 of the blind shield 30 located thereabelow and then is radiated to the lens 13. Finally, the light passing through the lens 13 is radiated not to the high-beam distribution area but to the low-beam distribution area.

Of course, after the light outputted from the light source 11 is reflected by the projection reflector 12, it may reach the lower surface 32 of the uppermost blind shield 30. Even in this case, the light reflected through the lower surface 32 of the uppermost blind shield 30 and the upper surface 31 of the blind shield 30 located therebelow passes through the lens 13 and is ultimately radiated to the low-beam distribution area.

Further, as shown in the drawing, light following an irradiation path M2 is light that is outputted from the light source 11, is reflected by the interior lower reflecting surface 12*a* of the projection reflector 12 and then is radiated towards the blind shield 30 located at a lower position. After this light is reflected through the lower surface 32 of the blind shield 30 and the upper surface 31 of the blind shield 30 located thereunder, it is radiated to the lens 13. The light passing through the lens 13 is ultimately radiated to the low-beam distribution area.

As described above, the present invention provides a shield apparatus for a low-beam head lamp, which includes blind shields to change the direction of a light radiated to a high-beam distribution area so that it is radiated to a low-beam distribution area, thus significantly increasing the amount of light radiated to the low-beam distribution area, and increasing light efficiency, therefore sufficiently satisfying the vehicle safety standard of every country.

For convenience in explanation and accurate definition in the appended claims, the terms "upper", "lower", "inner" and "outer", are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A shield apparatus for a low-beam head lamp, comprising:

a projection reflector equipped with a light source therein;

a shield body having a through hole being formed in the shield body towards a lens, wherein the shield body is coupled to a front surface of the projection reflector; and wherein the through hole includes a high beam distribution area and a lower beam distribution area; and a plurality of blind shields coupled to the shield body to cover the low-beam distribution area of the through hole and arranged one above another other, wherein the blind shields are inclined at a predetermined angle to guide an irradiation direction of light outputted from the light source towards the low-beam distribution area, and wherein, among the plurality of blind shields, an uppermost blind shield is formed such that a length thereof protruding towards the lens is longer than a length of the remaining blind shields.

2. The shield apparatus as set forth in claim 1, further comprising:

a shield cover integrally connecting opposite ends of each of the plurality of blind shields to each other, wherein the shield cover is fixedly coupled to the shield body.

3. The shield apparatus as set forth in claim 2, wherein each of the blind shields is installed at a downwardly inclined angle such that a first end thereof protruding towards the lens is located to be lower than an opposite second end thereof.

4. The shield apparatus as set forth in claim 2, wherein each of the blind shields has a triangular cross-section in such a way that a tip thereof faces towards the lens, thus guiding the irradiation direction of light reflected by the blind shield towards the low-beam distribution area.

5. The shield apparatus as set forth in claim 4, wherein, for a reference line that is perpendicular to a vertical cross-section of the shield body and connects the shield body to the tip of the blind shield, an angle between the reference line and an upper surface of the blind shield is larger than an angle between the reference line and a lower surface of the blind shield, thus guiding the irradiation direction of light reflected by the upper and lower surfaces of the blind shield towards the low-beam distribution area.

6. The shield apparatus as set forth in claim 5, wherein a determining factor for guiding the irradiation direction of the light outputted from the light source towards the low-beam distribution area comprises the angle between the reference line and the upper surface of the blind shield, the angle between the reference line and the lower surface of the blind shield, and a gradient angle of an interior lower reflecting surface of the projection reflector by which the light of the light source is reflected.

* * * * *